US005184352A

United States Patent [19]

Maufette

[11] Patent Number: 5,184,352

[45] Date of Patent: Feb. 9, 1993

[54] MOLDED PLASTIC BELT WITH INTEGRAL LOCKING MECHANISM

[75] Inventor: Claude Maufette, Montreal, Canada

[73] Assignee: Les Produits Pinso LTEE, Montreal, Canada

[21] Appl. No.: 766,343

[22] Filed: Sep. 27, 1991

[30] Foreign Application Priority Data

Oct. 16, 1990 [CA] Canada ..... 2027720

[51] Int. Cl.[5] ..... A44B 11/00

[52] U.S. Cl. ..... 24/585; 24/580; 24/616

[58] Field of Search ..... 24/585, 580, 581, 584, 24/586, 633, 170, 191, 168

[56] References Cited

U.S. PATENT DOCUMENTS

| | | | |
|---|---|---|---|
| 1,910,891 | 5/1933 | Freysinger | 24/585 |
| 4,282,634 | 8/1981 | Krauss | 24/616 |
| 4,578,843 | 4/1986 | Lewis | 24/580 |
| 4,727,630 | 3/1988 | Alan | 24/585 |
| 4,916,779 | 4/1990 | Terada et al. | 24/585 |
| 4,976,017 | 12/1990 | Frano | 24/585 |

FOREIGN PATENT DOCUMENTS

| | | | |
|---|---|---|---|
| 0286603 | 2/1953 | Switzerland | 24/585 |
| 1229454 | 4/1971 | United Kingdom | 24/633 |

*Primary Examiner*—Victor N. Sakran

*Attorney, Agent, or Firm*—Oblon, Spivak, McClelland, Maier & Neustadt

[57] ABSTRACT

A locking mechanism is integrally formed with a plastic belt or other flat band article where opposed end portions of a flat band need to be connected together. One of the band end portions has a lock housing mechanism at a free end thereof. The lock mechanism has a guide passageway for receiving and guiding the other band end portion through the lock housing mechanism. The other band end portion has a series of incremental engageable teeth which are engaged in the housing by an flexible arresting wedge to prevent the other band end portions to be retracted from the guide passageway of the lock housing. Finger actuable release tabs are accessible from the outside of the housing and provide for the disengagement of the arresting wedge with the incremental engaging teeth formed in the other band end portion for it to be retracted from the lock housing.

31 Claims, 5 Drawing Sheets

MOLDED PLASTIC BELT WITH INTEGRAL LOCKING MECHANISM

BACKGROUND OF INVENTION

1. Field of the Invention

The present invention relates to a locking mechanism for interconnecting two flexible flat band end portions, and preferably, but not exclusively, the end portions of a plastic belt which is worn about a user's waist, such as to hold pants or a skirt in place.

The conventional way in securing a belt about a wearer's waist is to provide at one end of the belt a buckle, and to perforate the other end of the belt with a series of equidistantly spaced holes in an end section of the belt. The spacing between these perforated holes are usually about three-quarters of an inch, but can vary and be as much as an A further disadvantage of the majority of these is that the buckles and the attachments are often an eyesore and do not blend with the belt design or color; they is in most cases necessary to discard the entire belt.

SUMMARY OF INVENTION

It is a feature of the present invention to provide a locking mechanism for interconnecting two flexible flat band end portions together, such as the ends of a belt for articles of garment, and which substantially overcomes the above-mentioned disadvantages of the prior art.

Another feature of the present invention is to provide a locking mechanism for interconnecting two flexible flat band end portions together, and which is integrally molded in a flexible plastic belt making it economical and esthetically pleasing to the eye.

Another feature of the present invention is to provide a locking mechanism for interconnecting two flexible flat band end portions together and wherein the mechanism provides small incremental adjustments, and wherein the adjustment increments produce an audible sound when being adjusted.

Another feature of the present invention is to provide a belt for articles of garment and wherein the belt is formed as a molded plastic band having an integrally formed locking mechanism and wherein belts of different colors or color combinations can be molded.

Another feature of the present invention is to provide a plastic molded belt having a novel locking mechanism which comprises a lock housing, and wherein decals or insignias can be integrally molded on the face of the lock housing or along the outer surface of the belt.

Another feature of the present invention is to provide a plastic molded belt for articles of garment and having an integrally molded locking mechanism which permits the belt to be quickly connected and disconnected.

According to the above features, from a broad aspect, the present invention provides a locking mechanism for interconnecting two flexible flat band end portions together. One of the band end portions has a lock housing mechanism at a free end thereof. The lock housing mechanism has a guide passageway for receiving and guiding the other of the band end portions through the lock housing mechanism. The other of the band end portions has incremental engageable means. The guide housing has flexible arresting means to engage with the incremental engageable means to prevent the other band end portion to be retracted from the guide passageway of the lock housing. Finger actuable release means is provided to disengage the arresting means from the engageable means to permit retraction of the other band portion from the lock housing mechanism.

BRIEF DESCRIPTION OF DRAWINGS

A preferred embodiment of the present invention will now be described with reference to the accompanying drawings in which.

DESCRIPTION OF PREFERRED EMBODIMENTS

Figure 1A:
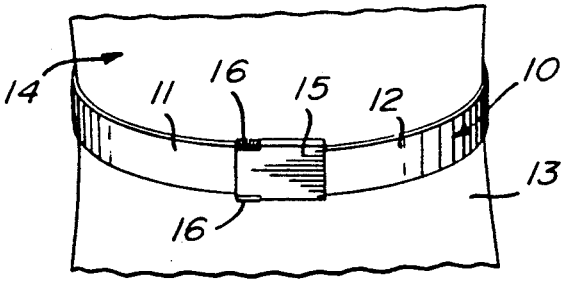
FIG. 1A is a perspective view showing the locking mechanism of the present invention as formed integral with a belt for use with a garment.

Referring now to the drawings and more particularly to FIG. 1A, there is shown a plastic belt 10 utilizing the locking mechanism of the present invention for securing two flexible opposed end portions 11 and 12 of the plastic belt together to secure the garment 13 about the wearer's waist 14. One end of the flexible belt has a lock housing mechanism secured in a lock housing 15, and which housing is integrally molded with the end portion 11 of the belt. Opposed finger actuable tabs 16 are used to disconnect the other band portion 12 from the lock housing 15.

Figure 1B:
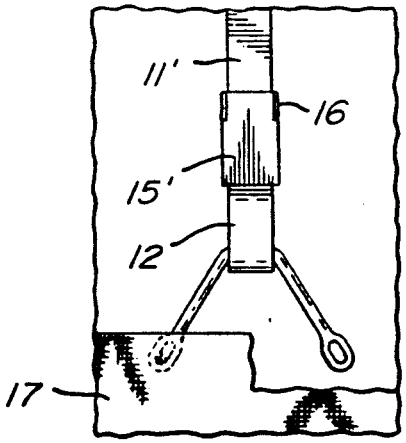
FIG. 1B is a perspective view showing the lock mechanism of the present invention for interconnecting two flexible flat band end portions of suspenders for an article of garment.

As shown in FIG. 1B, the locking mechanism, which will be described later, contained within the lock housing 15' can also be utilized to interconnect two flexible flat band end portions 11' and 12', herein integrated in the constructions of suspenders for holding a pant garment 17. Although the description that follows is more specifically concerned with a belt constructed of plastic material, the invention has many other applications, such as illustrated in FIG. 1B, and should therefore not be restricted to a belt which is worn about a wearer's waist.

Figure 3:
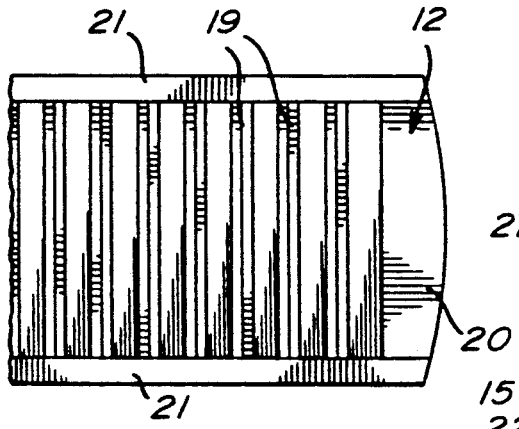
FIG. 3 is an end view of a flexible flat band end portion having a series of engageable teeth formed in a rear face thereof.
Figure 2:
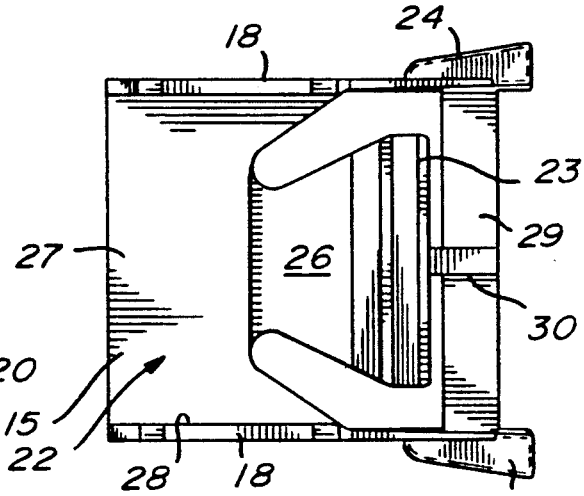
FIG. 2 is a section view of the lock housing showing the separate insert element secured therein.
Figure 8:
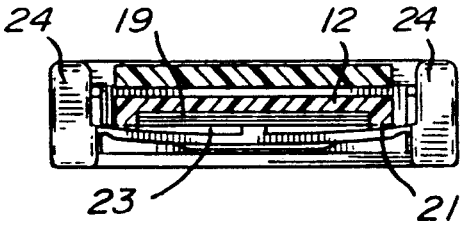
FIG. 8, is a cross-sectional rear view of the housing along section lines VIII—VIII of FIGS. 6D.
Figure 9:
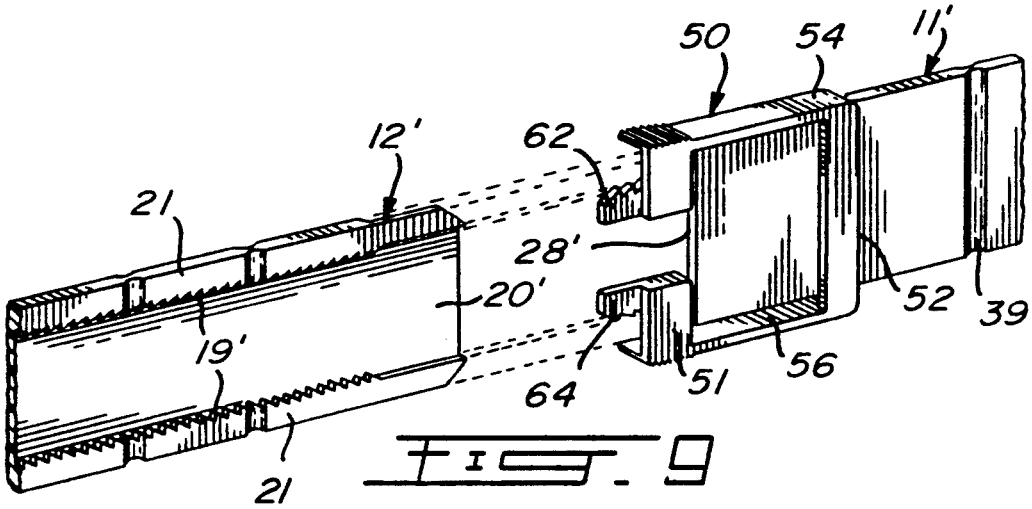
FIG. 9 is a rear perspective view of two ends of a belt showing an alternate construction of the lock housing mechanism of the present invention.
Figure 10:
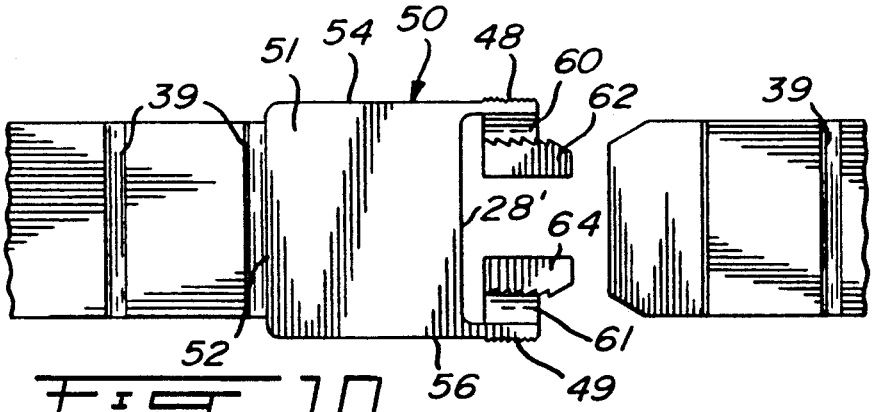
FIG. 10 is a front elevational view of FIG. 9.
Figure 11:
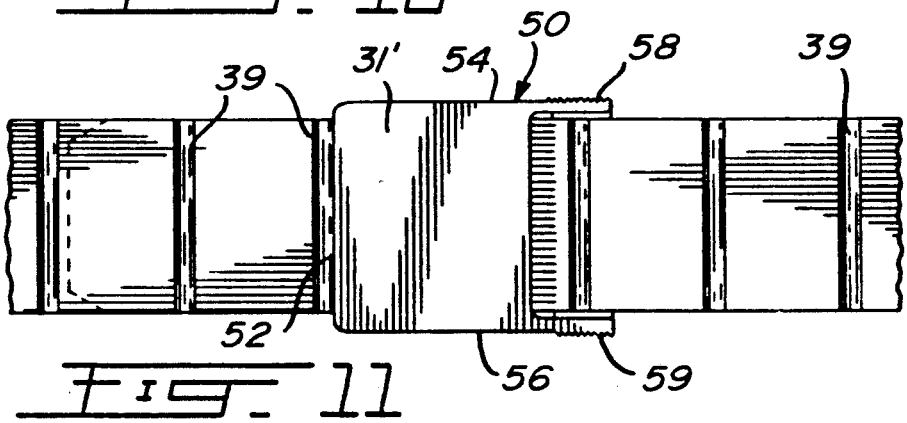
FIG. 11 is a front elevational view of the ends of the belt being engaged.
Figure 12:
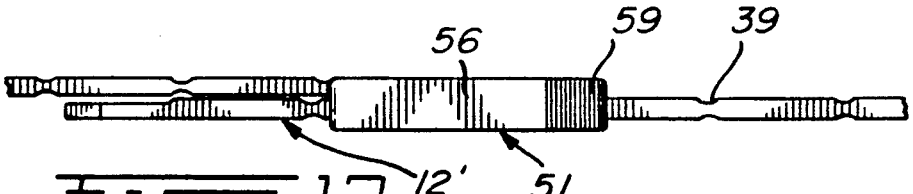
FIG. 12 is a side elevational view of FIG. 11.
Figure 13:
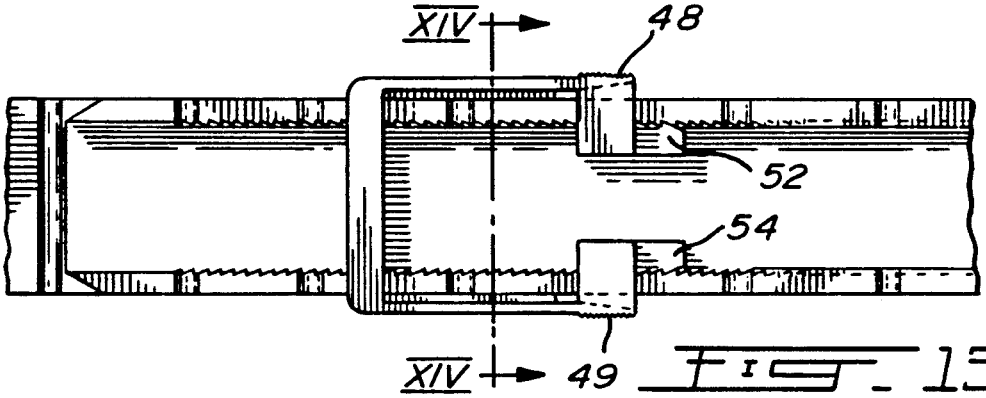
FIG. 13 is a rear elevational view of FIG. 11.
Figure 14:
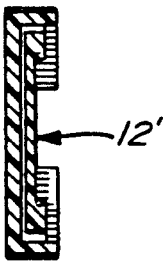
FIG. 14 is a cross-sectional view taken along cross-section lines XIV—XIV of FIG. 13.

Referring now more specifically to FIGS. 2 to 8, the locking mechanism of the present invention will now be described. As shown in FIG. 2, the lock housing 15 is integrally molded with one of the band end portions 11, and these can be molded from the same plastic material, or the lock housing may be molded from a more rigid plastic material than that of the belt section 11. Polyurethane plastic has been found very suitable for the construction of the belt. The lock housing defines a guide slot or passageway 28 for receiving and guiding the other belt end portion 12 through the lock housing mechanism. This other band end portion 12 has incremental engageable means in the form of a series of transverse teeth 19 formed in an inner face 20 thereof. As shown in FIGS. 3, 6B and 8, these teeth 19 extend within the inner surface and terminate space from opposed side edges of the band portion 12 to define opposed edge walls 21 at opposed ends of the teeth. The purpose of these edge walls will be described later.

A separate insert element 22 is retained captive in the housing 15, and is provided with a flexible arresting means in the form of a wedging transverse tooth 23 which is biased against the teeth 19 in the second end portion 12 to engage therewith and to prevent this other band end portion 12 from being retracted from the guide slot or passageway 28 of the lock housing when inserted therein. Finger actuable release means in the form of tabs 24 extend adjacent and in are pressed in the direction of the housing to disengage the transverse tooth 23 from its engagement with the teeth 19 in the belt end portion 12 to permit the belt end portion to be retracted from the housing. The operation of this mechanism follows.

Figure 4A:
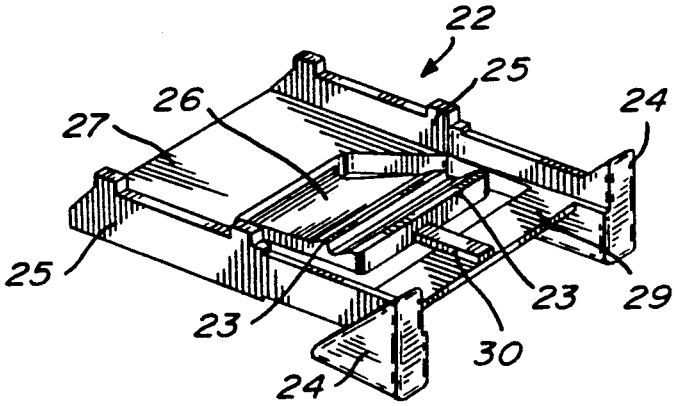
FIGS. 4A and 4B are perspective view of the insert element of FIG. 2 showing the operation thereof.
Figure 4B:
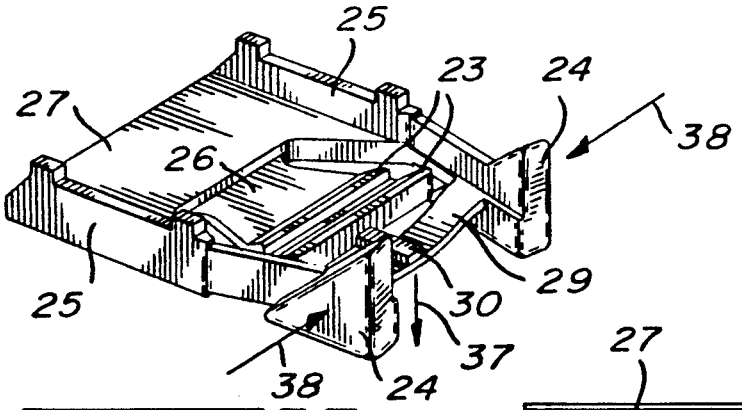
Figure 5:
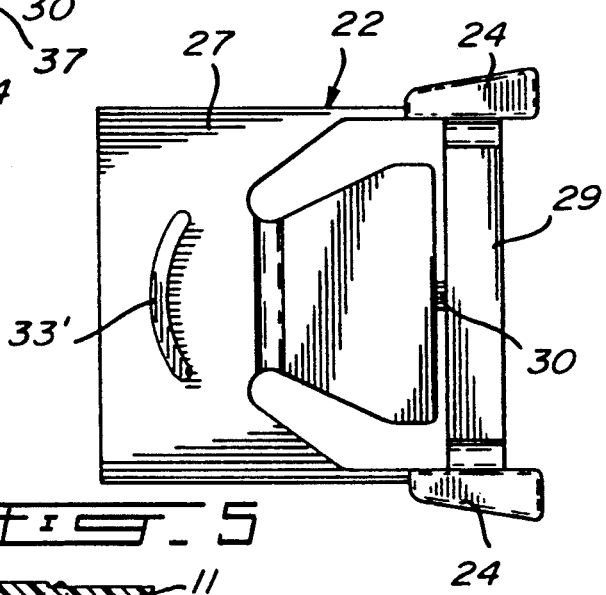
FIG. 5 is a bottom view of the insert element.
Figure 6A:
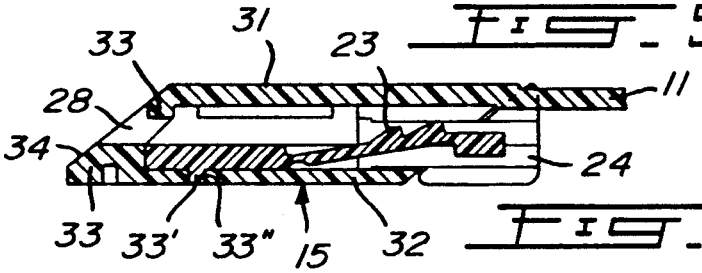
FIGS. 6A to 6D are sectional side view showing the manner in which the flexible band end portions are connected together and disconnected.
Figure 6B:
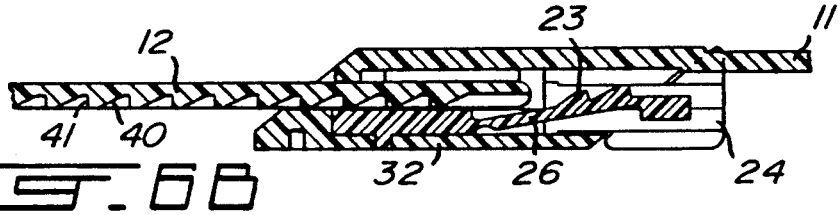
Figure 6C:
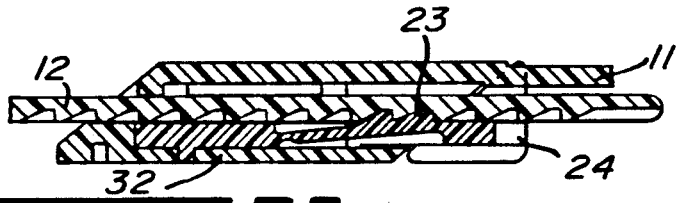

As shown more clearly in FIGS. 4A and 4B, the insert element 22 is a one-piece acetal plastic molded element and is comprised of two elongated rectangular ribs 25 extending spaced apart and parallel to one another. The flexible arresting means is comprised of a flat upwardly angulated divergent flexible wall 26 which extends from a central portion of a transverse flat bridge wall 27 disposed across the rectangular ribs 25 from a first end thereof and disposed along a lower peripheral edge portion of the ribs. The divergent flexible wall 26 has one or two transverse teeth 23 formed at a free end thereof and extending spaced between and transverse to the ribs 25. The angle of the divergent angulated wall 26 is better seen with reference to FIGS. 6A and 6B, and its disposition biases the teeth 23 against the engageable formation or teeth 19 in the belt end portion 12 when inserted into the housing, as shown in FIG. 6B. As the belt end portion 12 is pushed into the longitudinal slot 28 of the housing 15, it engages the angulated flexible wall 26 and pushes the teech 23 downwards, and the teeth 19 and 23 are oriented such as to create a friction-slip with one another when the end portion 12 is introduced into the housing. As can be seen in FIGS. 4A, 4B, 5 and 6A, the tabs 24 which form the finger actuable release means are interconnected by a flexible membrane 29 which is a narrow flexible plastic rib which is spaced from the end of the ribs 23 and interconnected with the divergent flexible wall 26 by a small connecting rib 30.

Figure 6D:
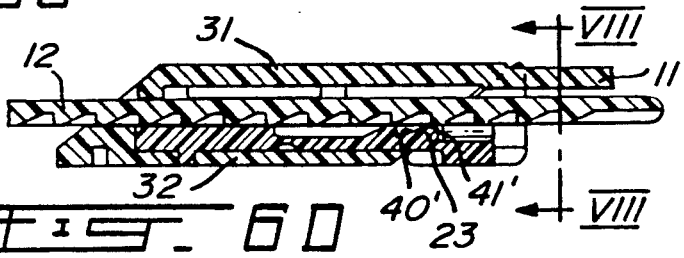
Figure 7:
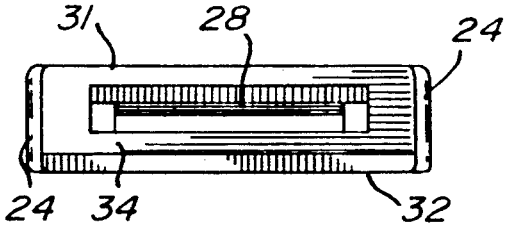
FIG. 7 is an end view of the lock housing showing the entrance slot thereto.

As shown in FIGS. 4B and 6D, when pressure is applied on the tabs 24 in the direction of the housing 15 shown by arrows 38, the flexible rib 29 will flex downwardly in the direction of arrow 37, retracting the wedging element or ribs 23 from engagement with teeth 19 in the belt end portion 12, thus permitting the belt end portion to be pulled out of the housing. As shown in FIG. 8, the edge walls 21 of the belt end portion 12 abut against the bridge wall 27 and the flexible membrane 29 at opposed ends thereof, and this forces the flexible rib 29 to bow away from the transverse teeth 19 in the belt and disconnect therefrom. The plastic utilized in molding the insert element is one capable of retaining its shape after flexing or bending.

Referring again to FIGS. 6A to 8, it can be seen that the lock housing defines a top wall 31, a pair of opposed side end walls 18, and a back wall 32 disposed parallel to the front wall 31. An opening is created between the end walls, the top and back walls, and constitutes the passageway. Once the separate insert element, which can also be referred to a cassette, is inserted within the passageway 33 by a locating pin formation 33' (See FIG. 5) under the bridge wall 27 which enters into a retention cavity 33" in the inner surface of the back wall 32. Accordingly, the cassette is snap-fitted into place. The leading end wall 34 is herein shown as an angulated transverse end wall with the longitudinal guide passageway 28 formed therein. The angulation of the wall 34 facilitates the location of the belt end portion within the passageway 28. As the end portion 12 is pushed through the passageway within the housing, the slipping engagement of the teeth 23 with the wedging tooth 19 causes a clicking audible sound each time a tooth 19 is displaced against the wedging tooth 23, and this provides an indication to the user of finite belt adjustments, of approximately six per inches, when positioned about his waist. Unlike the belt buckles of the prior art it can be seen that adjustment can be made extremely quickly and simply by pushing the belt end portion within the housing and finite adjustment can be achieved.

The transverse teeth in both the belt end portion 12 and in the wedging element each have a sloping front wall 40 and a transverse rear retention wall 41 for the belt end portion 12, and 40' and 41' respectively for the wedging ribs 23.

Referring now to FIGS. 9 to 15, there will be described another embodiment of the lock housing and incremental engageable means. The lock housing is a rectangular body 50 having a plain outer surface 51, and end wall 52 including a slot to allow passage of the belt end portion 12' therethrough. The rectangular body 50 also has opposite side walls 54 and 56, each displaying at one end thereof leg portions 48 and 49 having tongues 60 and 61 inwardly facing one another. The tongues 60 and 61 each have a ratchet element 62 and 64 provided with teeth adapted to engage teeth 19' formed in a pair of flanges 21 along the belt end portion 12'. The belt may also have a series of transverse crimps 39 to provide spaced apart hinges having more flexibility so that the belt can be more easily bent.

The end portions of the belt are interconnected in a similar manner as defined with respect to the first embodiment, and this is done by positioning the belt end portion 12' into the opening 28' of the housing or rectangular body 50 and out through the side opening of end wall 52. In this manner, the tongues 60 and 61 sapced under the walls 54 and 56 of the housing 50 guide their ratchet teeth 62 and 64 in slipping engagement with the teeth 19' formed on the inner surface 20' of the belt end section 12'. The teeth configuration of the engaged teeth prevents retraction of the belt end portion 12' from the housing opening 28', as previously described.

To disengage the ends of the belt from one another, finger pressure is applied on leg portions 48 and 49 (See FIG. 15) in the direction of arrows 66 and 68, thus distancing the engaged teeth from one another, and by pulling the belt end portion 12' in the direction of arrow 70 disconnects the end portion 12' from the housing. The material of the housing 50, at least in the area of the leg portions 48 and 49, requires some resiliency to permit the unbuckling and the return of the leg portions to their original position after a compressing operation.

Figure 16:
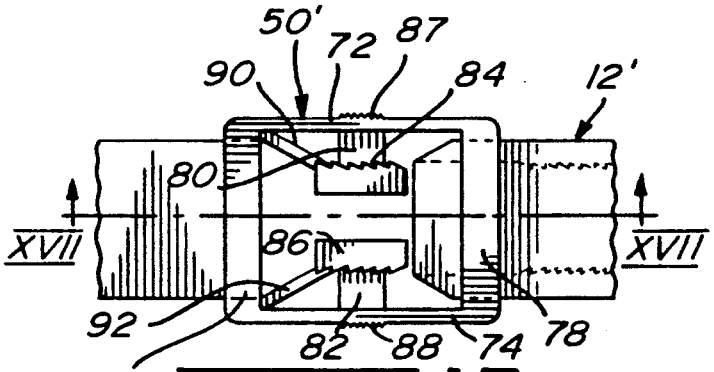
FIG. 16 is a front elevational view showing another embodiment of the present invention.
Figure 15:
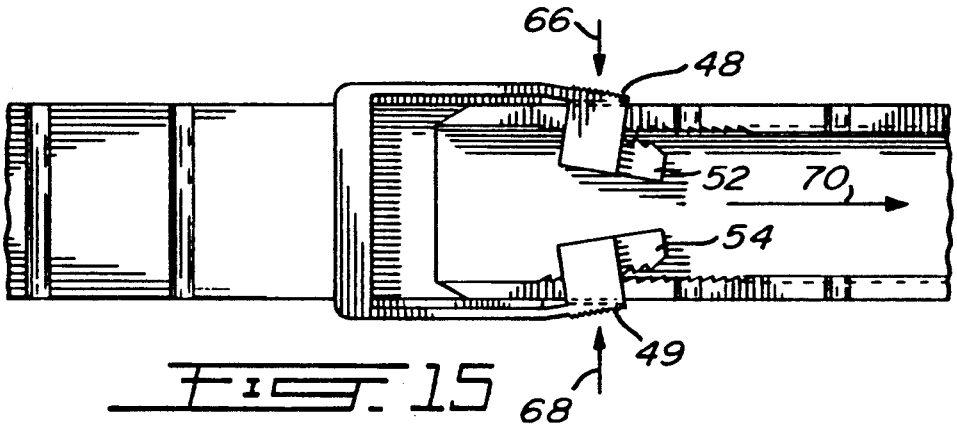
FIG. 15 is a view similar to FIG. 13 showing the disengagement step.
Figure 17:
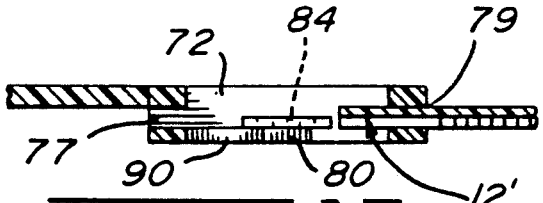
FIG. 17 is a cross-sectional view taken along lines XVII—XVII of FIG. 16.

FIGS. 16 and 17 shows a variation of the incremental engageable means shown in FIGS. 9 to 14. As herein shown, the housing 50' also consists of an annular rectangular body having side walls 72 and 74 and opposite end walls 76 and 78. Each end wall has an opening 77 and 79 allowing the insertion of the belt end portion 12' therethrough. The opposite side walls 72 and 74 each includes in the center thereof a pair of inwardly directed tongues 80 and 82 carrying ratchet teeth 84 and 86.

The belt end portions are interconnected together in a manner similar to that previously described. Similarly, the disengagement is accomplished by inwardly flexing the resilient center finger gripping portions 87 and 88 of the side walls 72 and 74 to free the engagement of the ratchet teeth 84 and 86 from the teeth on the inner face of belt end portion 12'. In this embodiment a pair of diagonal members 90 and 92 connects the ratchet carrying means 84 and 86 to their corresponding walls 72 and 74 to reinforce the structure of the ratchet carrying means.

Figure 18:
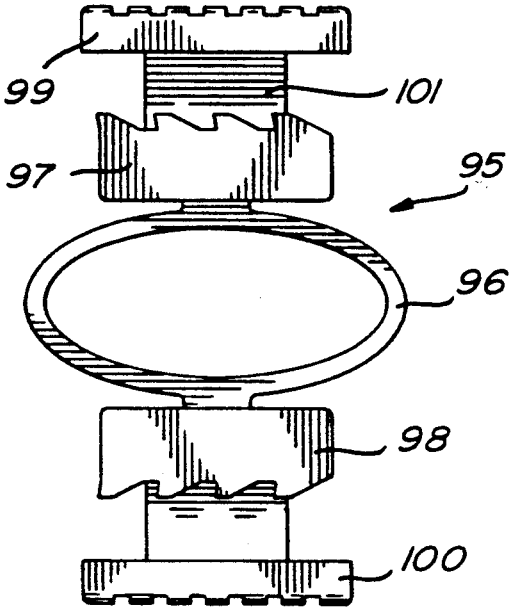
FIG. 18 is a front elevational view of a further embodiment of the locking mechanism.
Figure 19:
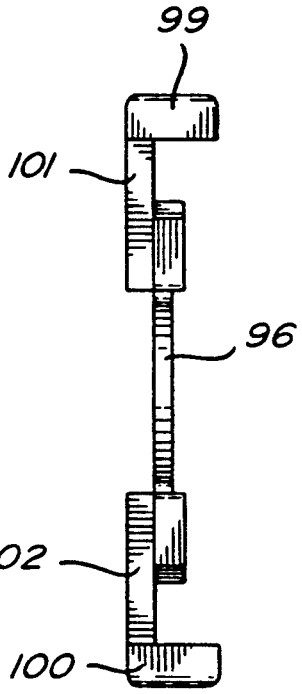
FIG. 19 is a side view of FIG. 18.

Referring now to FIGS. 18 and 19, there is shown a still further embodiment and wherein the ratchet carrying means is a separate insert element 95 and which is retained captive in a guide housing similar to that as previously described with reference to FIGS. 16 and 17, but modified to accommodate this type of ratchet carrying means. Such modification need not be described in detail, as it is now obvious in view of preceding descriptions and drawings. The insert element 95 is a plastic molded element having a flexible membrane formed as a plastic ring member 96 having the ratchet elements 97 and 98 integrally formed therewith and diametriclaly connected thereto on opposed sides of the ring. Finger actuable tabs 99 and 100 are interconnected to the ratchet elements 97 and 98 by a retracted connecting wall 101 and 102. By applying transverse pressure across the ribs 99 and 100 in the direction of ring 96, the ring will be caused to distort and flex bringing the ratchet elements 97 and 98 closer to one another and disconnecting them from teeth 19' formed in the horizontal flanges 21 of the belt end portion 12'.

This further ratchet carrying means is being shown to show the various modifications that can be made to the present invention and which are intended to be covered by the scope of the present invention. It is therefore within the ambit of the present invention to cover any obvious modifications provided such fall within the scope of the appended claims.

We claim:

1. A locking mechanism for interconnecting two flexible flat band end portions together, one of said band end portions having a lock mechanism at a free end thereof, said locking mechanism having a lock housing with a guide passageway for receiving and guiding the other of said band end portions through said lock housing, said other of said band end portions having incremental engageable means constituted by toothed means formed in an inner face of said other of said band end portion, said lock housing having a separating locking insert element retained captive in said lock housing, said locking insert element having a flexible member provided with arresting means to engage with said incremental engageable means to prevent said other band end portion to be retracted from said guide passageway of said lock housing, and finger actuable release means being connected to said flexible member to disengage said arresting means from said engageable means to cause said flexible member to flex to move said arresting means out of engagement with said incremental engageable means to permit retraction of said other band portion from said lock housing.

2. A locking mechanism as claimed in claim 1 wherein said arresting means is a wedging element which is resiliently biased against said incremental engageable means by said flexible element and in friction-slip therewith when said other band end portion is introduced in said passageway, and in retention engagement when said other end portion is stationary in said passageway.

3. A locking mechanism as claimed in claim 2 wherein said lock housing has a top wall, a pair of opposed side end walls and a back wall parallel to said front wall, and an opening between said pair of side end walls and said top and back walls, said opening constituting said passageway.

4. A locking mechanism as claimed in claim 3 wherein said finger actuable release means is actuable from at least an adjacent one of said opposed side end walls of said housing.

5. A locking mechanism as claimed in claim 4 wherein there are two finger actuable release means, one adjacent a respective one of said pair of opposed side end walls of said housing.

6. A locking mechanism as claimed in claim 5 wherein said two finger actuable release means are tabs integrally formed at opposed ends of a flexible membrane, said flexible membrane being connected to said flexible element to disconnect said wedging element from engagement with said engageable formations when said membrane is caused to bow in a predetermined direction to draw said flexible element and said wedging element away from said engageable formations.

7. A locking mechanism as claimed in claim 6 wherein said engageable formations are a series of transverse teeth formed in said inner face of said other band end portion.

8. A locking mechanism as claimed in claim 7 wherein said wedging element is an elongated transverse tooth formed integral with said flexible element and resiliently biased against said series of transverse teeth when said other band end portion is introduced in said housing.

9. A locking mechanism as claimed in claim 7 wherein said separate insert element is a one-piece plastic molded element comprised of two elongated rectangular ribs extending spaced apart and parallel to one another, said flexible element being a flat upwardly angulated divergent flexible wall extending from a central portion of a transverse flat bridge wall disposed across said rectangular ribs from a first end thereof and disposed along a lower peripheral edge portion thereof, said divergent flexible wall having a transverse tooth formed at a free end thereof and extending spaced between and transverse to said ribs and constituting said wedging element, said membrane being a narrow flexible rib spaced from said free end of said divergent wall and connected across the other end of said ribs adjacent said finger actuable release means, said narrow rib being connected by a small connecting rib to said free end of said divergent wall below said tooth.

10. A locking mechanism as claimed in claim 9 wherein said other end of said ribs have an enlarged end section on an outer face thereof, said enlarged end section protruding above said opposed side end walls of said lock housing when said separate insert element is retained captive in said housing.

11. A locking mechanism as claimed in claim 9 wherein said series of said transverse teeth in said inner face of said other band portion extend within said inner face and terminate spaced from opposed side edges of said band portion to define an edge wall at opposed ends of said transverse teeth, said edge walls abutting against end sections of said narrow flexible rib when said other band portion is inserted in said housing to force said narrow flexible rib to bow away from said transverse teeth.

12. A locking mechanism as claimed in claim 11 wherein said transverse teeth each has a rearwardly sloping front wall and a transverse rear retention wall, said transverse tooth forming said wedging element having a sloping front wall extending rearwardly of an entrance end of said passageway and a transverse rear retention wall, said tooth being dimensioned to mate with said transverse teeth of said other band portion.

13. A mechanism as claimed in claim 2 wherein the opening extends between a leading and trailing end of said housing, said leading end being an angulated transverse end wall with a longitudinal slot therein for receiving said other flexible flat band portion substantially parallel to and between said front and back wall.

14. A locking mechanism as claimed in claim 13 wherein said two flexible flat band end portions are constituted by the end portions of an elongated flexible plastic belt, said lock housing being integrally molded in a free end of said belt.

15. A locking mechanism as claimed in claim 14 wherein said wedging element is a plastic element and when in said friction slip with said engageable formations formed in said end portion of said plastic belt generating a clicking audible sound each time a formation is disposed thereagainst when said other end portion of said belt is introduced in said housing to indicate a tightening incremental adjustment of said belt about a wearer's waist, said lock housing constituting a belt buckle.

16. A locking mechanism for interconnecting two flexible flat band end portions together, one of said band end portions having a lock mechanism at a free end thereof, said lock mechanism having a lock housing with a guide passageway for receiving and guiding the other of said band end portions through said lock housing, said other of said band end portions having incremental engageable means, said lock housing having flexible arresting means to engage with said incremental engageable means to prevent said other band end portion to be retracted from said guide passageway of said lock housing, and finger actuable release means to disengage said arresting means from said engageable means to permit retraction of said other band portion from said lock housing, said incremental engageable means being a series of engageable formations formed in an inner face of said other end portion and engageable by said flexible arresting means, said flexible arresting means being a wedging element which is resiliently biased against said engageable formations and in friction-slip therewith when said other band end portion is introduced in said passageway and in retention engagement when said other end portion is stationary in said passageway, said lock housing having a top wall, a pair of opposed side end walls and a back wall parallel to said front wall, and an opening between said pair of side end walls and said top and back walls, said opening constituting said passageway, said flexible arresting means being part of a separate insert element held captive in said housing, said finger actuable release means being actuable from at least one of said opposed side end walls of said housing.

17. A locking mechanism as claimed in claim 16 wherein said finger actuable release means is integrally formed with and connected to said wedging element of said flexible arresting means, there being two finger actuable release means, one in a respective one of said pair of opposed side end walls of said housing.

18. A locking mechanism as claimed in claim 17 wherein said two finger actuable release means are tabs integrally formed at opposed ends of a flexible membrane, said flexible membrane being connected to said flexible arresting means to disconnected said wedging element from engagement with said engageable formations when said membrane is caused to bow in a predetermined direction to draw said flexible arresting means and said wedging element away from said engageable formations.

19. A locking mechanism as claimed in claim 18 wherein said engageable formations are a series of transverse teeth formed in said inner face of said other band end portion.

20. A locking mechanism as claimed in claim 19 wherein said wedging element is an elongated transverse tooth formed integral with said flexible arresting means and resiliently biased against said series of transverse teeth when said other band end portion is introduced in said housing.

21. A locking mechanism as claimed in claim 19 wherein said separate insert element is a one-piece plastic molded element comprised of two elongated rectangular ribs extending spaced apart and parallel to one another, said flexible arresting means being a flat upwardly angulated divergent flexible wall extending from a central portion of a transverse flat bridge wall disposed across said rectangular ribs from a first end thereof and disposed along a lower peripheral edge portion thereof, said divergent flexible wall having a transverse tooth formed at a free end thereof and extending spaced between and transverse to said ribs and constituting said wedging element, said membrane being a narrow flexible rib spaced from said free end of said divergent wall and connected across the other end of said ribs adjacent said finger actuable release means, said narrow rib being connected by a small connecting rib to said free end of said divergent wall below said tooth.

22. A locking mechanism as claimed in claim 21 wherein said other end of said ribs have an enlarged end section on an outer face thereof, said enlarged end section protruding above said opposed side end walls of said lock housing when said separate insert element is retained captive in said housing.

23. A locking mechanism as claimed in claim 21 wherein said series of said transverse teeth in said inner face of said other band portion extend within said inner face and terminate spaced from opposed side edges of said band portion to define an edge wall at opposed ends of said transverse teeth, said edge walls abutting against end sections of said narrow flexible rib when said other band portion is inserted in said housing to force said narrow flexible rib to bow away from said transverse teeth.

24. A locking mechanism as claimed in claim 21 wherein said transverse teeth each has a rearwardly sloping front wall and a transverse rear retention wall, said transverse tooth forming said wedging element having a sloping front wall extending rearwardly of an entrance end of said passageway and a transverse rear retention wall, said tooth being dimensioned to mate with said transverse teeth of said other band portion.

25. A locking mechanism as claimed in claim 23 wherein said transverse teeth each has a rearwardly sloping front wall and a transverse rear retention wall, said transverse tooth forming said wedging element having a sloping front wall extending rearwardly of an entrance end of said passageway and a transverse rear retention wall, said tooth being dimensioned to mate with said transverse teeth of said other band portion.

26. A locking mechanism for interconnecting two flexible flat band end portions together, one of said band end portions having a lock mechanism at a free end thereof, said lock mechanism having a lock housing with a guide passageway for receiving and guiding the other of said band end portions through said lock housing, said other of said band end portions having incremental engageable means, said lock housing having flexible arresting means to engage with said incremental engageable means to prevent said other band end portion to be retracted from said guide passageway of said lock housing, and finger actuable release means to disengage said arresting means from said engageable means to permit retraction of said other band portion from said lock housing, said incremental engageable means is constituted by longitudinal toothed means formed in an inner face of said other of said band end portion, said flexible arresting means being a ratchet carrying means having ratchet means engageable with said toothed means to engage said one of said band end portions with said other band end portion; said ratched carrying means, at least in the area of said ratchet means, being resilient whereby said ratched means is moved out of engagement with said toothed means to free said one of said band ends of said other band end portion, said inner face displaying opposite longitudinal flanges, said toothed means being provided on said flanges, said ratchet carrying means being comprised of a body having a pair of opposite tongues, said ratchet means having of toothed means engageable with the toothed means on said opposite flanges.

27. A locking mechanism as claimed in claim 25 wherein said body has a flat outer rectangular surface displaying a pair of opposite leg portions extending longitudinally from one side thereof; said ratchet means being provided on said leg portions.

28. A locking mechanism as claimed in claim 25 wherein said body defines an annular rectangular shape; said ratchet means being provided centrally on opposite longitudinal sides of said body.

29. A locking mechanism as claimed in claim 25 wherein said band is made of flexible material.

30. A locking mechanism as claimed in claim 25 wherein said housing constitutes a belt buckle, said incremental engageable means being a series of teeth urged against said flexible arresting means when said other band end portion is introduced in said housing, said arresting means being an engaging tooth in friction-slip with said series of teeth and generating a clicking sound each time it contacts a tooth of said series of teeth when said other band end portion is introduced or displaced in said housing.

31. A locking mechanism for interconnecting two flexible flat band end portions together, one of said band end portions having a lock mechanism at a free end thereof, said lock mechanism having a housing with a guide passageway for receiving and guiding the other of said band end portions through said lock housing, said other of said band end portions having incremental engageable means, said lock housing having flexible arresting means to engage with said incremental engageable means to prevent said other band end portion to be retracted from said guide passageway of said lock housing, and finger actuable release means to disengage said arresting means from said engageable means to permit retraction of said other band portion from said lock housing, said incremental engageable means being constituted by longitudinal toothed means formed in an inner face of said other of said band end portion, said flexible arresting means being a ratchet carrying means having ratchet means engageable with said toothed means to engage said one of said band end portions with said other band end portion; said ratchet carrying means, at least in the area of said ratchet means, being resilient whereby said ratchet means is moved out of engagement with said toothed means to free said one of said band ends of said other band end portion, said inner face displaying opposite longitudinal flanges, said toothed means being provided on said flanges, said ratchet carrying means being a separate insert element retained captive in said guide housing, said insert element being a plastic molded element having a flexible membrane with said toothed means being formed at opposed ends of said flexible means, said finger actuable release means being connected to a respective one of said toothed means.

* * * * *